United States Patent [19]

Boda

[11] Patent Number: 4,650,429

[45] Date of Patent: Mar. 17, 1987

[54] THROTTLE FRICTION DEVICE FOR OUTBOARD MOTOR

[75] Inventor: James C. Boda, Winneconne, Wis.

[73] Assignee: Brunswick Corporation, Skokie, Ill.

[21] Appl. No.: 765,015

[22] Filed: Aug. 9, 1985

[51] Int. Cl.[4] ..... B63H 21/21

[52] U.S. Cl. ..... 440/87; 74/531; 74/480 B

[58] Field of Search ..... 440/87; 74/531, 480 B, 74/532; 403/104

[56] References Cited

U.S. PATENT DOCUMENTS

| | | | |
|---|---|---|---|
| 2,546,157 | 3/1951 | Hume | 403/351 |
| 2,841,425 | 7/1958 | Oeters | 403/104 |
| 3,782,219 | 1/1974 | Beck et al. | 74/531 |
| 3,955,438 | 5/1976 | Zakrzewski | 440/87 |

*Primary Examiner*—Joseph F. Peters, Jr.
*Assistant Examiner*—Paul E. Salmon
*Attorney, Agent, or Firm*—O. T. Sessions

[57] ABSTRACT

An adjustment is provided for the friction between a throttle hand grip (12) and the steering arm (10) of an outboard motor. An internal cam surface (32) in knob (15) will press against a corresponding external cam surface (31) on the throttle control handle (19) to allow adjustment of the friction between the throttle control handle (19) and the steering arm tube (17) by rotating the knob (15).

8 Claims, 3 Drawing Figures

THROTTLE FRICTION DEVICE FOR OUTBOARD MOTOR

DESCRIPTION

TECHNICAL FIELD

The invention relates to throttle control devices for outboard motors and more particularly to a device for adjusting the friction on the throttle control.

BACKGROUND ART

It is common to use a twisting hand grip on the tiller arm of an outboard motor to control the engine throttle setting. U.S. Pat. No. 3,782,219 to Beck, et al, shows one such device having a threaded knob to adjust the friction resisting movement of the twist grip throttle controller.

DISCLOSURE OF INVENTION

The present invention provides a throttle control mechanism for an outboard motor having a steering arm attached to the outboard motor and a throttle control hand grip mounted for rotation about a control axis fixed on the steering arm. A friction means is used to create a frictional force between the hand grip and the steering arm to resist rotation of the hand grip. A cam means is provided for adjusting the frictional force.

The cam means can take the form of a cam element mounted on the hand grip to deform a portion of the hand grip and force that portion into frictional engagement with the steering arm.

Such a device can be readily provided by mounting a collar for rotation about the throttle control hand grip and providing an internal cam surface on the collar engaging an external cam surface on the hand grip.

A device in accord with the invention will be easy to manufacture and very easy to use.

BEST MODE FOR CARRYING OUT THE INVENTION

Figure 1:
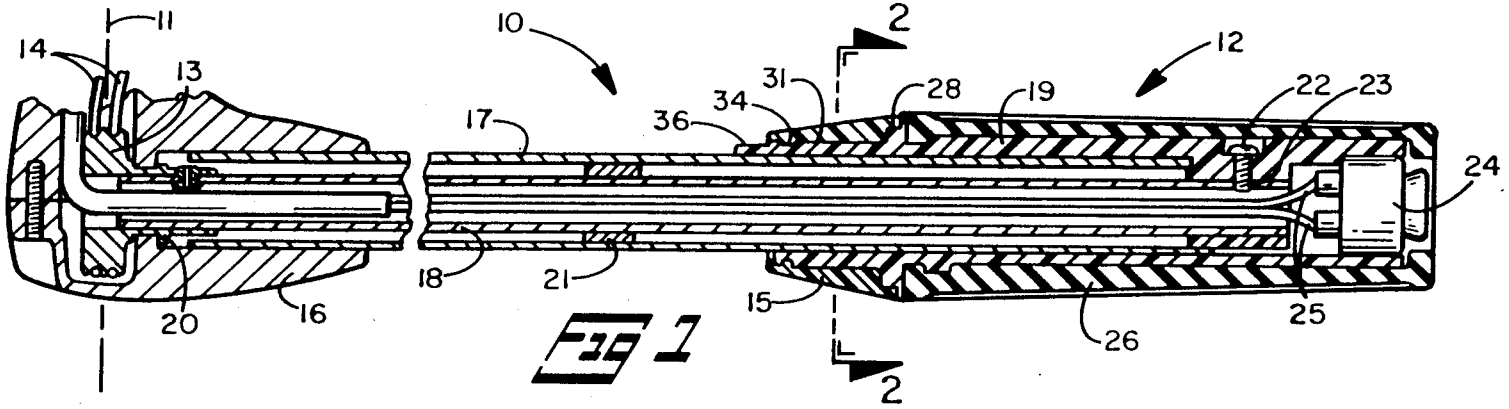
FIG. 1 is a sectional view through the tiller arm of an outboard motor incorporating the invention.

FIG. 1 shows a steering tiller arm 10 for an outboard motor. The steering arm 10 is pivotally mounted to a motor housing so the arm can be raised and lowered about an axis 11. The motor throttle is controlled by twisting a hand grip 12 mounted on the steering arm 10 to rotate a pulley 13 at the inward end of the steering arm 10. Cables 14 engaging the pulley 13 are connected to operate the throttle mechanism, not illustrated. A collar 15, mounted on the hand grip 12, allows adjustment of the frictional force between the hand grip 12 and the tiller arm 10 by rotating the collar 15 relative to the hand grip 12.

The tiller arm assembly is made up of a bracket 16 pivotally attached to the outboard motor housing, a tiller arm tube 17 pressed into the bracket 16, a throttle control tube 18 mounted rotationally inside the tiller arm tube 17, and a throttle control handle 19 mounted for rotation on the tiller arm tube 17 and fixed to the throttle control tube 18. The throttle control pulley 13, mounted inside the bracket 16, is fixed to rotate with the throttle control tube 18. The pulley hub 20 is journalled in the bracket 16 and a bearing 21 is provided in the tiller arm tube 17 between the tiller arm tube 17 and the throttle control tube 18 to allow free rotation of the throttle control tube 18 and pulley 13. The throttle control handle 19 is mounted over the outer end of the tiller arm tube 17 and is fixed to the throttle control tube 18 by a screw 22 engaging a threaded hole 23 in the throttle control tube 18. The throttle control handle 19 is thus journalled on the outer surface of the tiller arm tube 17 to rotate about a control axis corresponding with the axis of the tiller arm tube 17. An engine kill switch 24, mounted in the end of the throttle control handle 19, is connected to the engine by wires 25 extending through the pulley 13 and throttle control tube 18. An elastomeric outer covering 26 is provided over the throttle control handle 19 to provide a comfortable grip for the operator.

Figure 3:
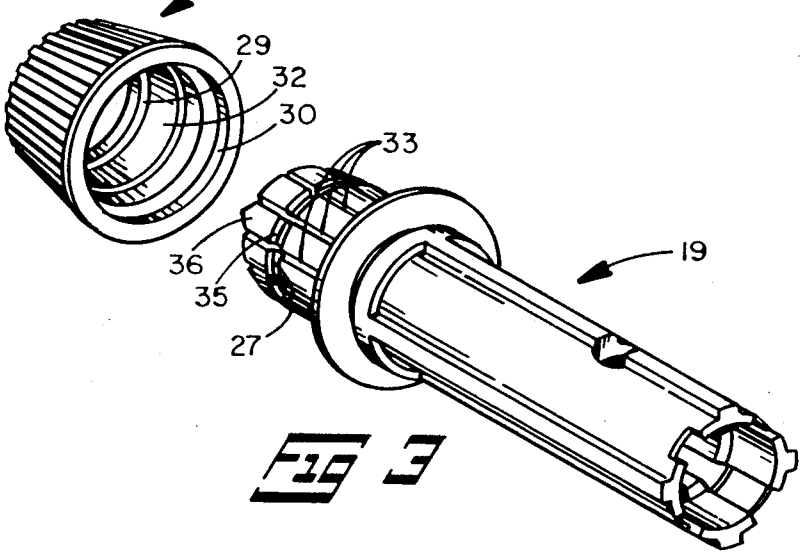
FIG. 3 is a sectional view of two of the basic components of the invention.
Figure 2:
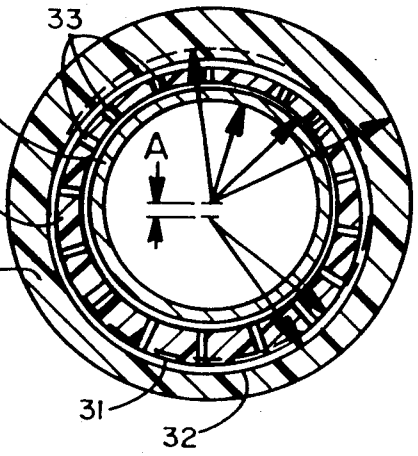
FIG. 2 is a sectional view taken along the line 2—2 of FIG. 1.

As most clearly shown in FIGS. 2 and 3, the friction control knob 15 is mounted on the inner end of the throttle control handle 19 to adjust the friction between the throttle control handle 19 and the tiller arm tube 17. The friction control knob 15 has the shape of a collar and is journalled on two circular bearing surfaces 27 and 28 formed on the throttle control handle 19 concentric with the tiller arm tube 17. The two bearing surfaces 27 and 28 on the throttle control handle 19 engage two circular concentric bearing surfaces 29 and 30 inside the friction control knob 15. An external cam surface 31 is formed on the throttle control handle 19 between the two bearing surfaces 27 and 28. The cam surface 31 is circular, but its center is displaced a distance A from the center of the tiller arm tube 17, as most clearly shown in FIG. 2. An internal cam surface 32 is formed inside the friction control knob 15 between the two concentric bearing surfaces 29 and 30 to engage the external cam surface 31. The internal cam surface 32 is also circular, with its center displaced from the axis of the tiller arm tube 17 by the distance A.

Axial slots 33 are formed in the inner end of the throttle control handle 19 through the cam surface 31 to allow the cammed portion of the throttle control handle 19 to be more readily compressed against the tiller arm tube 17. An annular ridge 34, formed inside the friction control knob 15, engages the groove 35 which includes the bearing surface 27 on the throttle control handle 19. The friction control knob 15 can thus be snapped into place over the inner end of the throttle control handle 19 and held in place by the engaging ridge 34 and groove 35.

A pointer 36 can be formed on the inside end of the throttle control handle 19 to extend through the knob 15. Indicia of the throttle position can be provided on the tiller arm tube 17, with the pointer 36, to give a visual indication of the throttle setting.

Preferably the knob 15 is formed by injection molding of a nylon material while the throttle control handle 19 is formed of acetal resin. These materials have adequate strength while providing suitable frictional characteristics without excessive wear.

The friction which resists rotation of the throttle control handle 19 can be adjusted by merely rotating the friction control knob 15 relative to the throttle control handle 19. As the knob 15 is rotated, the eccentric cam surface 32 in the knob 15 will press against the corresponding eccentric surface 31 on the throttle control handle 19, thus compressing a portion of the throttle control handle 19 against the tiller arm tube 17. Rotation of the knob 15 by 180 degrees from the position shown in FIG. 2 will give the maximum friction between the throttle control handle 19 and the tiller arm tube 17, while the position shown in FIG. 2 will give the minimum friction. The device thus cannot be adjusted to create excessive friction. Since the knob 15 rotates about the axis of the tiller arm tube 17, the circular external configuration of the grip will not be changed by rotating the knob 15. The invention thus provides a very convenient adjustment for the throttle friction which also allows an engine kill switch 24 or other device to be positioned in the end of the throttle control handle 19.

I claim:

1. A throttle control mechanism for an outboard motor comprising:

(A) a steering arm attached to said outboard motor;

(B) a throttle control handle mounted for rotation about a control axis fixed on said steering arm to operate a throttle linkage in response to rotation of said handle relative to said arm;

(C) a friction means for creating a frictional force between said handle and said steering arm to resist rotation of said handle; and (D) a cam means for adjusting said frictional force, said cam means including a cam element rotatably mounted at a fixed axial location on said handle to deform a portion of said handle and force said portion into frictional engagement with said steering arm as said cam element is rotated relative to said handle.

2. The throttle control mechanism defined in claim 1 wherein said cam element is mounted for rotation about a cam axis parallel to said control axis.

3. The throttle control mechanism defined in claim 2 wherein said cam axis coincides with said control axis.

4. The throttle control mechanism defined in claim 3 wherein said cam means further comprises a cam surface fixed on said hand grip.

5. The throttle control mechanism defined in claim 4 wherein said handle includes axial slots through said second cam element.

6. A throttle control mechanism for an outboard motor comprising:

(A) a steering arm attached to said outboard motor;

(B) a throttle control handle mounted for rotation about a control axis fixed on said steering arm, said handle having a rotational bearing surface coaxial with said control axis and a first cam surface extending about said control axis;

(C) a collar mounted for rotation on said rotational bearing surface and axially fixed on said handle, said collar having a second cam surface engaging said first cam surface; and (D) a friction means for creating a frictional force between said handle and said steering arm to resist rotation of said handle, said cam surfaces reacting to relative rotation between said handle and said collar to adjust said frictional force, said friction means including an inner cylindrical surface of said handle, said inner cylindrical surface located radially inward from said first and second cam surfaces.

7. The throttle control mechanism defined in claim 6 wherein said handle includes axial slots through said first cam surface and said inner cylindrical surface.

8. A throttle mechanism for an outboard motor comprising:

(A) a steering arm attached to said outboard motor, said steering arm including an external cylindrical surface portion;

(B) a throttle control handle mounted for rotation about a control axis fixed on said steering arm to operate a throttle linkage in response to rotation of said handle, said handle including an internal cylindrical surface portion encircling said external cylindrical portion, said handle including axial slots through said internal cylindrical portion;

(C) a cam means mounted on said throttle control handle for deforming said internal cylindrical portion to contact said external cylindrical portion and adjustably control the frictional force between said throttle control handle and said steering arm, said cam means including a first cam having a first cam surface encircling said cylindrical portions and a second cam surface formed on said handle encircling said cylindrical portions, said first and second cam surfaces movable relative to each other to adjust said frictional force, whereby the force required to operate said throttle mechanism may be adjusted.

* * * * *